United States Patent [19]

Germain

[11] 4,185,648

[45] Jan. 29, 1980

[54] MACHINE FOR TREATING SHEETS OF VARIABLE WIDTH

[75] Inventor: Alfred M. J. Germain, Grande Synthe, France

[73] Assignee: Union Siderurgique du Nord et de l'Est de la France, "USINOR", Paris, France

[21] Appl. No.: 974,017

[22] Filed: Dec. 28, 1978

[30] Foreign Application Priority Data

Dec. 30, 1977 [FR] France ..... 77 39834

[51] Int. Cl.[2] ..... B08B 3/04

[52] U.S. Cl. ..... 134/122 R; 134/154; 134/183

[58] Field of Search ..... 266/102, 111-115; 134/64 R, 64 P, 83, 122 R, 122 P, 133-134, 154, 182-183, 199; 68/244; 29/116 AD; 100/93 RP, 153, 168-171

[56] References Cited

U.S. PATENT DOCUMENTS

| | | | |
|---|---|---|---|
| 2,940,458 | 6/1960 | Speckman | 134/182 X |
| 3,885,581 | 5/1975 | Dahan et al. | 134/122 R |
| 4,073,661 | 2/1978 | Buzga et al. | 134/183 X |

FOREIGN PATENT DOCUMENTS

| | | | |
|---|---|---|---|
| 412259 | 6/1974 | U.S.S.R. | 266/111 |

*Primary Examiner*—Robert L. Bleutge
*Attorney, Agent, or Firm*—Cushman, Darby & Cushman

[57] ABSTRACT

The machine is designed mainly to effect an accelerated cooling of metal sheets and is improved in order to permit efficient operation with sheets of variable width. For this purpose, sets of elements forming baffles are disposed on each side of the longitudinal axis of the machine along edges of the latter. Depending on whether they are withdrawn into or not withdrawn into their housings, these elements modify the conditions of the flow of the cooling liquid in the machine.

7 Claims, 4 Drawing Figures

MACHINE FOR TREATING SHEETS OF VARIABLE WIDTH

DESCRIPTION

The present invention relates to machines for treating sheets and in particular machines for cooling sheets of the type disclosed in U.S. Pat. No. 3,885,581 by the Applicant.

Such a machine comprises a lower frame and an upper frame in which frames are mounted sets of sheet guiding and driving rollers, these rollers being surrounded by a case which defines an enclosure in which the cooling liquid flows. This case defines on each side of the sheet and around the rollers relatively narrow gaps in which the cooling liquid flows at high speeds. Such a machine is usually designed to be capable of treating sheets of great width, for example of around 4 meters, and the problem that the invention concerns resides in permitting an adaptation of the machine to the treatment of sheets of smaller width. Indeed, it is to be feared that, for a sheet of a width which is much less than the width of the machine, there will be produced preferential passages for the cooling liquid on each side of the sheet so that the cooling of the latter will be less even over the width and less effective than desired, so that the efficiency of the machine will be reduced.

In order to solve this problem, the object of the invention is to provide a special arrangement in a machine for cooling metal sheets as defined above and comprising a lower frame and an upper frame carrying sets of sheet guiding and driving rollers and a case surrounding the rollers and defining an enclosure for the cooling fluid, wherein there is provided in at least some of the zones of the case disposed between the zones extending round the rollers, baffles withdrawable in housings adapted to reduce, in some regions, the effective width of the machine and promote the flow of the cooling fluid in the central zone of the machine through which the sheet travels.

According to other features of the invention:

There are provided, on each side of the longitudinal axis of the machine, sets of a plurality of baffle elements whereby it is possible to regulate the effective width of the machine at different values.

Each set of baffle elements is carried by a single support which is detachably mounted on the corresponding frame of the machine.

The baffles are formed by sheet metal flaps having a thickness which is small enough to enable them to be withdrawn into their housing after having been accidentally deformed.

The invention will be described in more detail hereinafter with reference to the accompanying drawings which are given solely by way of example and in which.

Figure 1:
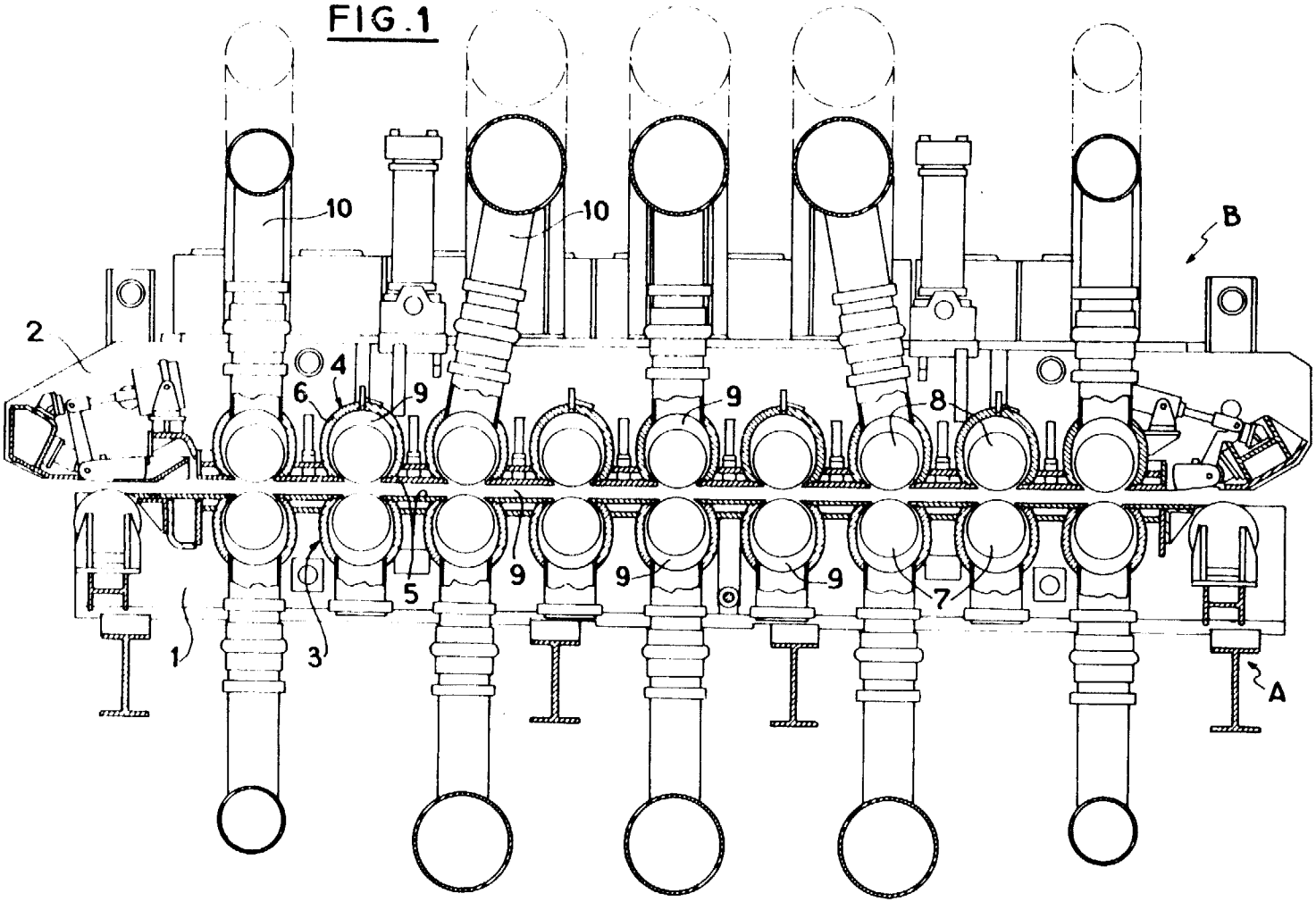
FIG. 1 is a longitudinal sectional view of a cooling machine in which the improvement according to the invention is incorporated.

FIG. 1 shows the arrangement of a cooling machine comprising a lower frame A and an upper frame B. Each frame has lateral walls 1, 2 interconnected by metal cases 3, 4 including roughly planar portions 5 parallel to the metal sheet and curved portions 6 which extend round the rollers 7, 8. Nine pairs of gripping rollers are provided which serve to guide and drive the metal sheet travelling through this machine. The cases 3, 4 define an enclosure 9 in which the cooling fluid is made to flow, this enclosure being connected to supply and discharge pipes 10 for this fluid.

Figure 2:
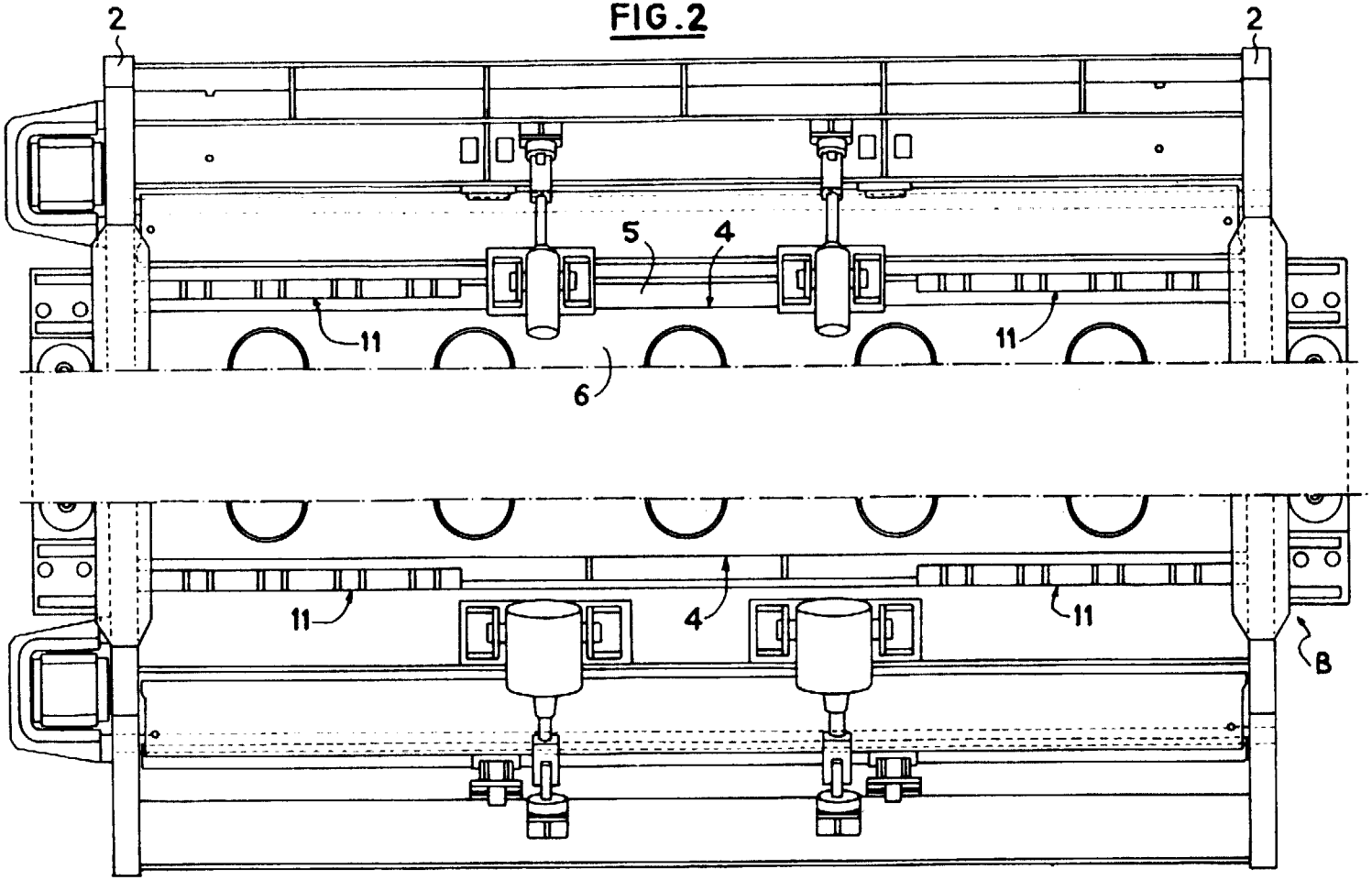
FIG. 2 is a partial plan view of, in particular, the arrangement of the baffles.
Figure 3:
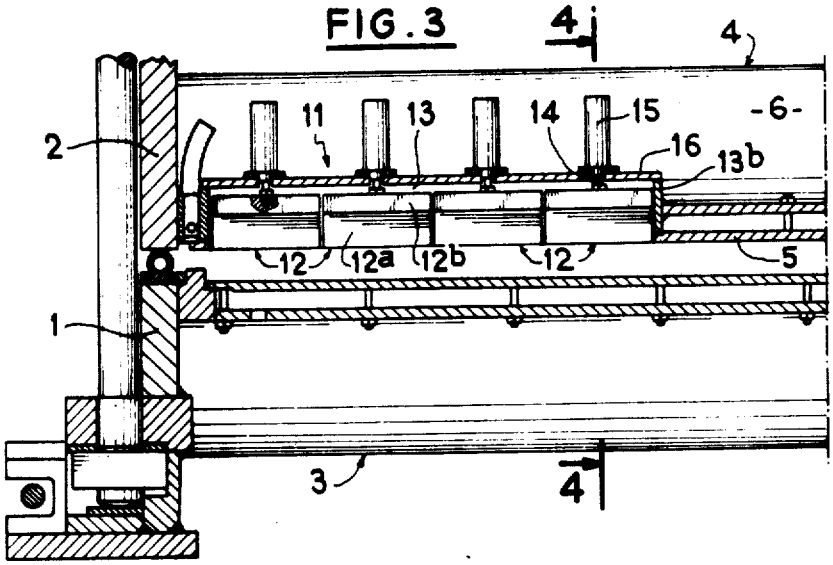
FIG. 3 is a sectional view to an enlarged scale of a set of elements forming a baffle.
Figure 4:
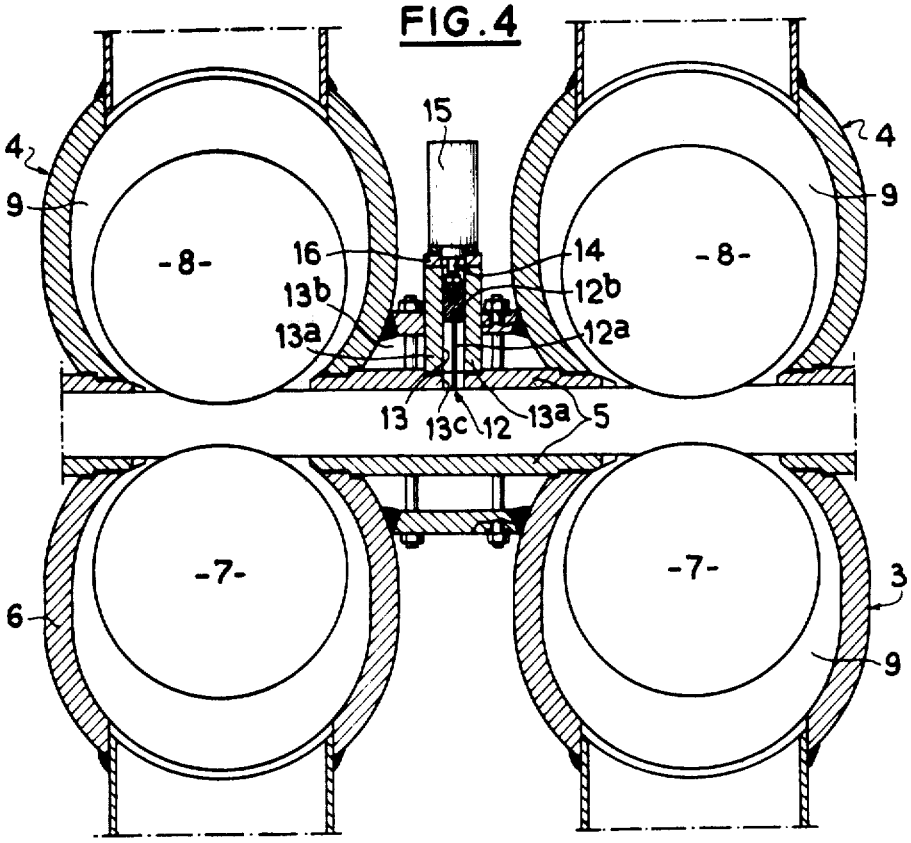
FIG. 4 is a sectional view taken on line 4—4 of FIG. 3.

According to the invention, in the roughly planar portions 5 of the case located between adjacent rollers, there are provided sets of baffles 11 disposed on each side of the longitudinal axis of the machine adjacent the edges of the latter as shown more clearly in FIG. 2. In the illustrated embodiment, each set of baffles comprises four elements 12 of sheet metal which are received in housings 3 defined by longitudinal walls 13*a* and transverse walls 13*b* which are fixed to the case 3 and therefore to the upper frame. These housings communicate by way of their lower part 13*c* with the cooling enclosure 9. Each baffle element 12 comprises a flap 12*a* of thin sheet metal (for example 2 mm thick) fixed in a thicker bar 12*b* which is connected to the end of a piston rod 14 of a jack 15 and is guided in the housing 13. The four jacks of a given set of baffles are fixed to a single support formed by a plate 16 which is detachably fixed to the walls of the housings 13. Each baffle element 12*a* may be accidentally deformed by a metal sheet travelling through the machine and yet it is capable of being withdrawn after having undergone this deformation. As can be seen in FIG. 2, each gap between two adjacent rollers has a set of baffles 11 disposed on each side of the machine. However, it will be understood that such baffles constituting a barrier may be provided only at more or less regular intervals along the machine and also that the number of elements may be changed in each set. As an extreme example, only a single element may be provided.

The operation of such a device is very simple: if the machine treats metal sheets of great width, the elements 12 forming a baffle are maintained in their withdrawn position inside their housings and in no way modify the flow of the cooling fluid inside the machine.

On the other hand, if a sheet of smaller width must be treated, a suitable number of baffle elements are shifted and brought to their lower position in which they form barriers which oppose the flow of the fluid in the longitudinal direction of the machine on each side of the sheet. These barriers then produce high pressure drops in the lateral zones so that the flow of the cooling fluid on the two faces of the sheet in the central zone of the machine is facilitated. The cooling of the sheet is then optimum and the efficiency of the machine is thus improved. The fact of providing in each set a plurality of baffle elements which are separate and actuated separately, provides great flexibility and enables the machine to be adapted to sheets whose width may vary, for example, between 1.5 and 4 meters.

Having now described my invention what I claim as new and desire to secure by Letters Patent is:

1. A machine for treating, and in particular cooling, metal sheets, comprising a lower frame and an upper frame, sets of sheet guiding and driving rollers carried by the upper frame and lower frame, a case carried by each frame and surrounding the rollers and defining an enclosure for cooling fluid, said cases having first zones surrounding the rollers and second zones between the first zones, baffle means disposed in at least some of the second zones of the case and housings combined with the baffle means, the baffle means being movable between a position in which the baffle means are withdrawn into the housings and a position in which the baffle means extend out of the housings and create a transverse barrier in regions of the enclosure and thereby reduce the effective transverse width of the enclosure of the machine and promote the flow of the cooling fluid in the central zone of the enclosure of the machine in which the sheet travels.

2. A machine as claimed in claim 1, wherein each baffle means comprises a shifting jack fixed relative to the frame, a piston rod of the jack and a thin metal sheet which is carried by the piston rod and is withdrawable into the corresponding housing.

3. A machine as claimed in claim 1, wherein there are sets of baffle means and a single support carries each set of baffle means and is detachably fixed to the corresponding frame of the machine.

4. A machine as claimed in claim 1, wherein the baffle means comprise sheet metal flaps which are thin enough to enable the flaps to be withdrawn into the corresponding housings after the flaps have been accidentally deformed.

5. A machine as claimed in claim 1, wherein each baffle means comprises a thin sheet metal flap, a guide bar combined with the flap and shifting means associated with the guide bar for shifting the flap.

6. A machine as claimed in any one of the claims 1 to 5, comprising, on each side of a longitudinal axis of the machine, sets of a plurality of said baffle means whereby the effective transverse width of the enclosure of the machine may be adjusted to different values.

7. A machine as claimed in any one of the claims 1 to 5, wherein the baffle means are carried by the upper frame of the machine.

* * * * *